US012747118B2

(12) United States Patent
Mitamura

(10) Patent No.: US 12,747,118 B2
(45) Date of Patent: Sep. 29, 2026

(54) SHEET FEEDING APPARATUS, IMAGE READING APPARATUS, AND IMAGE FORMING APPARATUS

(71) Applicant: CANON KABUSHIKI KAISHA, Tokyo (JP)

(72) Inventor: Akiyuki Mitamura, Inashiki (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 18/449,729

(22) Filed: Aug. 15, 2023

(65) Prior Publication Data

US 2023/0382668 A1 Nov. 30, 2023

Related U.S. Application Data

(63) Continuation of application No. 16/738,134, filed on Jan. 9, 2020, now Pat. No. 11,767,183.

(30) Foreign Application Priority Data

Jan. 18, 2019 (JP) ..... 2019-007228

(51) Int. Cl.
*B65H 3/06* (2006.01)
*B65H 5/06* (2006.01)

(52) U.S. Cl.
CPC ..... *B65H 3/0684* (2013.01); *B65H 3/0638* (2013.01); *B65H 3/0653* (2013.01); (Continued)

(58) Field of Classification Search
CPC ..... B65H 1/08; B65H 1/14
See application file for complete search history.

(56) References Cited

U.S. PATENT DOCUMENTS 6,260,839 B1 7/2001 Araki
6,349,931 B1 2/2002 Kuo
(Continued)

FOREIGN PATENT DOCUMENTS

JP 2006-232453 A 1/2006
JP 2007-137526 A 1/2007
(Continued)

OTHER PUBLICATIONS

Jun. 4, 2024 Japanese Official Action in Japanese Patent Appln. No. 2023-094606.
(Continued)

*Primary Examiner* — Howard J Sanders
(74) *Attorney, Agent, or Firm* — Venable LLP

(57) ABSTRACT

A sheet feeding apparatus includes: a conveying roller; a separating roller which forms a nip portion by pressing the conveying roller and separates a sheet conveyed by the conveying roller one by one in the nip portion; a moving portion configured to move a stacking portion from a first position at which a sheet stacked in the stacking portion and a feeding roller are separated from each other to a second position at which the sheet stacked in the stacking portion abuts on the feeding roller; and a cover member which is movable between a third position to cover a rotation shaft of the separating roller and a fourth position to expose the rotation shaft of the separating roller, in which the cover member placed in the fourth position moves to the third position along with movement of the stacking portion from the first position to the second position.

18 Claims, 15 Drawing Sheets

(52) U.S. Cl.
CPC ... *B65H 5/068* (2013.01); *B65H 2301/42324* (2013.01); *B65H 2301/44324* (2013.01); *B65H 2402/441* (2013.01)

(56) References Cited

U.S. PATENT DOCUMENTS

| | | | | |
|---|---|---|---|---|
| 6,540,220 | B2 | 4/2003 | Kuo | |
| 7,753,355 | B2 | 7/2010 | Mitamura | |
| 8,393,614 | B2 | 3/2013 | Mitamura | |
| 8,752,832 | B2 | 6/2014 | Mitamura | |
| 9,272,868 | B2 * | 3/2016 | Hamada | B65H 31/00 |
| 9,904,228 | B2 | 2/2018 | Xie | |
| 10,091,372 | B2 | 10/2018 | Shiota | |
| 10,345,754 | B2 | 7/2019 | Shiga | |
| 11,760,590 | B2 | 9/2023 | Mitamura | |
| 11,767,183 | B2 | 9/2023 | Mitamura | |
| 11,780,693 | B2 | 10/2023 | Mitamura | |
| 2015/0203309 | A1 | 7/2015 | Hamada | |
| 2017/0279991 | A1 | 9/2017 | Shiota | |
| 2018/0148285 | A1 | 5/2018 | Suzuki | |
| 2019/0193970 | A1 | 6/2019 | Yamaguchi | |
| 2020/0189865 | A1 | 6/2020 | Yamaguchi | |
| 2020/0231395 | A1 | 7/2020 | Mitamura | |
| 2022/0041385 | A1 | 2/2022 | Mitamura | |
| 2022/0041386 | A1 | 2/2022 | Mitamura | |
| 2023/0382668 | A1 | 11/2023 | Mitamura | |

FOREIGN PATENT DOCUMENTS

| | | | |
|---|---|---|---|
| JP | 2014-045301 | A | 1/2014 |
| JP | 2017-171426 | A | 1/2017 |
| JP | 2020-117316 | A | 8/2020 |

OTHER PUBLICATIONS

Dec. 6, 2022 Japanese Official Action in Japanese Patent Appln. No. 2019-007228.

* cited by examiner

SHEET FEEDING APPARATUS, IMAGE READING APPARATUS, AND IMAGE FORMING APPARATUS

BACKGROUND OF THE INVENTION

Field of the Invention

An embodiment of the present invention relates to a sheet feeding apparatus suitable for an image forming apparatus such an electrophotographic copying machine that forms an image on a sheet by using an electrophotographic process, a laser beam printer, or the sheet feeding apparatus suitable for an image reading apparatus such as a scanner.

Description of the Related Art

In the sheet feeding apparatus, a configuration including a feed roller that conveys a fed sheet, and a separating roller that forms a nip portion with the feed roller by pressing the feed roller and that separates a sheet, which is conveyed to the feed roller, one by one in the nip portion has been known.

In a case where such a sheet feeding apparatus is continuously used, along with abrasion of the separating roller or attachment of paper power, which is generated from a sheet, to the separating roller, there is a case where the separating roller is replaced by a user or an operator who performs maintenance. Here, in Japanese Patent Laid-Open No. 2017-171426, a configuration in which a separating roller is replaced after a cover member that covers a rotation shaft of the separating roller is moved and the rotation shaft is exposed is described.

In the configuration described in Japanese Patent Laid-Open No. 2017-171426, a case where it is forgotten to move the cover member after replacement of the separating roller and a sheet is fed in a state in which the rotation shaft of the separating roller is exposed is assumed. In this case, there is a possibility that the sheet is stuck with the cover member protruded to a side of a conveyance path of the sheet or the rotation shaft of the separating roller, the sheet gets jammed, and a jam is generated.

SUMMARY OF THE INVENTION

An object of the present invention is to provide a sheet feeding apparatus that can suppress generation of a jam of a sheet even in a case where it is forgotten to move a cover member in replacement of a separating roller.

A representative configuration of the present invention is a sheet feeding apparatus comprising:

- a stacking portion in which a sheet is stacked;
- a feeding roller configured to feed the sheet stacked in the stacking portion;
- a conveying roller configured to convey the sheet fed by the feeding roller;
- a separating roller which forms a nip portion by pressing the conveying roller and separates the sheet conveyed by the conveying roller one by one in the nip portion;
- a moving portion configured to move the stacking portion from a first position at which the sheet stacked in the stacking portion and the feeding roller are separated from each other to a second position at which the sheet stacked in the stacking portion abuts on the feeding roller; and
- a cover member which is movable between a third position to cover a rotation shaft of the separating roller and a fourth position to expose the rotation shaft of the separating roller,

- wherein the cover member placed in the fourth position moves to the third position along with movement of the stacking portion from the first position to the second position.

Further features of the present invention will become apparent from the following description of exemplary embodiments with reference to the attached drawings.

DESCRIPTION OF THE EMBODIMENTS

First Embodiment

<Image Reading Apparatus>

In the following, a whole configuration of an image reading apparatus including a sheet feeding apparatus according to the first embodiment of the present invention will be described with reference to the drawings. Note that a dimension, a material, a shape, a relative arrangement, and the like of a component described in the following are not to limit the scope of this invention only to these unless there is a specific description in particular.

Figure 1B:
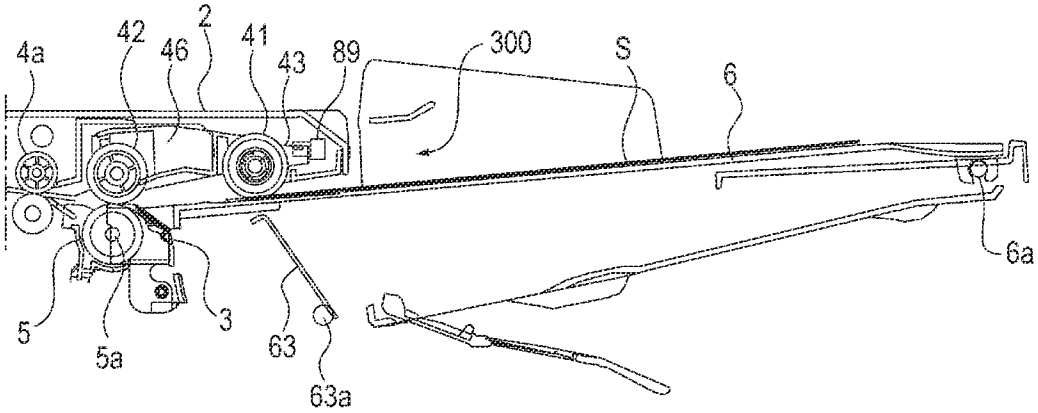
FIGS. 1A and 1B are cross-sectional schematic views of an image reading apparatus.
Figure 1A:
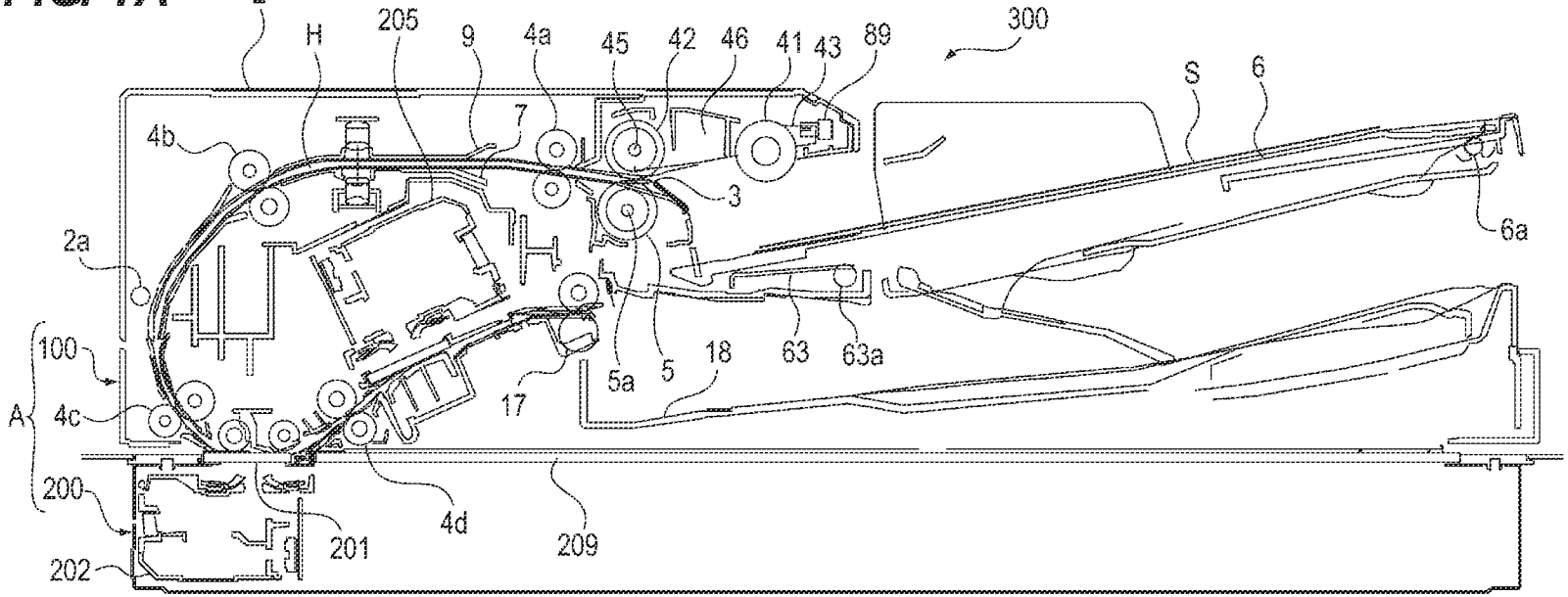

FIGS. 1A and 1B are cross-sectional schematic views of an image reading apparatus A. Here, FIG. 1A is a view illustrating a state in which an original tray 6 is placed in a standby position (described later), and FIG. 1B is a view illustrating a state in which the original tray 6 is placed in a feeding position (described later).

As illustrated in FIG. 1, the image reading apparatus A includes a reader 200 and an ADF 100. The ADF 100 is a device that reads an image on a sheet S while automatically conveying the sheet S. The ADF 100 is rotatably supported with respect to the reader 200 by a hinge (not illustrated).

The reader 200 includes a first scanner unit 202 (image reading portion) that reads an image on the sheet S that is an original, a first glass plate 201 on which the sheet S is placed, and an original base plate glass 209 arranged side by side with the first glass plate 201 in a sub-scanning direction. By being driven by a driving force by a motor (not illustrated), the first scanner unit 202 moves between a position on a lower side of the first glass plate 201 and a position on a lower side of the original base plate glass 209.

First, the sheet S is placed on the original base plate glass 209 when an image is read by the reader 200. Next, the first scanner unit 202 scans an image read surface of the sheet S with light through the original base plate glass 209 while moving, receives reflected light with an image sensor, and reads image data on the sheet S. Note that it becomes possible to access the original base plate glass 209 by rotating and making the ADF 100 opened to an upper side.

The ADF 100 includes a second scanner unit 205 (image reading portion) that reads an image on the sheet S on a downstream side, compared to the first scanner unit 202, of a conveyance path H in which the sheet S is conveyed. The second scanner unit 205 scans the image read surface on the sheet S with light, receives reflected light with an image sensor, and reads image data on the sheet S.

Also, the ADF 100 includes an original tray 6 (stacking portion) in which the sheet S is stacked, and a pick roller 41 (feeding roller) that picks up and feeds the sheet S stacked in the original tray 6. Also, a feed roller 42 (conveying roller) that conveys the sheet S stacked in the original tray 6, and a separating roller 5 that forms a separating nip portion by pressing the feed roller 42 and that separates the sheet, which is conveyed by the feed roller 42, one by one in the separating nip portion are included. Also, a pair of feed rollers 4 (4*a* to 4*d*) that conveys the sheet S conveyed by the feed roller 42 and separated into one by the separating roller 5 is included. The original tray 6, the pick roller 41, the feed roller 42, the separating roller 5, and the like are included in a sheet feeding apparatus 300 that feeds the sheet S.

The original tray 6 is rotatably supported by a tray supporting shaft 6*a*. Also, a lifter 63 axially supported by a lifter driving shaft 63*a* is provided in a lower side of the original tray 6. When the lifter driving shaft 63*a* is rotated by a driving force by a lifter driving motor 84, the lifter 63 rotates clockwise along with this and the lifter 63 abuts on the original tray 6. When the lifter 63 further rotates, the original tray 6 rotates around the tray supporting shaft 6*a* and a leading end portion of the original tray 6 is lifted. When the leading end portion of the original tray 6 is lifted, the sheet S stacked in the original tray 6 abuts on the pick roller 41, and it becomes possible to feed the sheet S by the pick roller 41.

In such a manner, the original tray 6 rotates and moves between a standby position (first position) in which the sheet S stacked in the original tray 6 and the pick roller 41 are separated from each other, and a feeding position (second position) in which the sheet S stacked in the original tray 6 abuts on the pick roller 41. The lifter 63 is a moving portion that moves the original tray 6 from the standby position to the feeding position.

The pick roller 41 is supported by a pick arm 46. The pick arm 46 is rotatably supported with respect to a rotation shaft 45 that axially supports the feed roller 42, and a rotation thereof is controlled by a rotation of a cam (not illustrated). Also, the rotation shaft 45 is rotatably supported by an opened/closed cover 2 that is an exterior cover. That is, the opened/closed cover 2 supports the pick roller 41 and the feed roller 42 through the rotation shaft 45. Also, the pick arm 46 is constantly biased to a lower side by a spring (not illustrated). By this biasing force, the pick roller 41 presses the sheet S in the original tray 6 when the original tray 6 is placed in the feeding position. Note that a rotating operation of the pick arm 46 will be described later.

Figure 4:
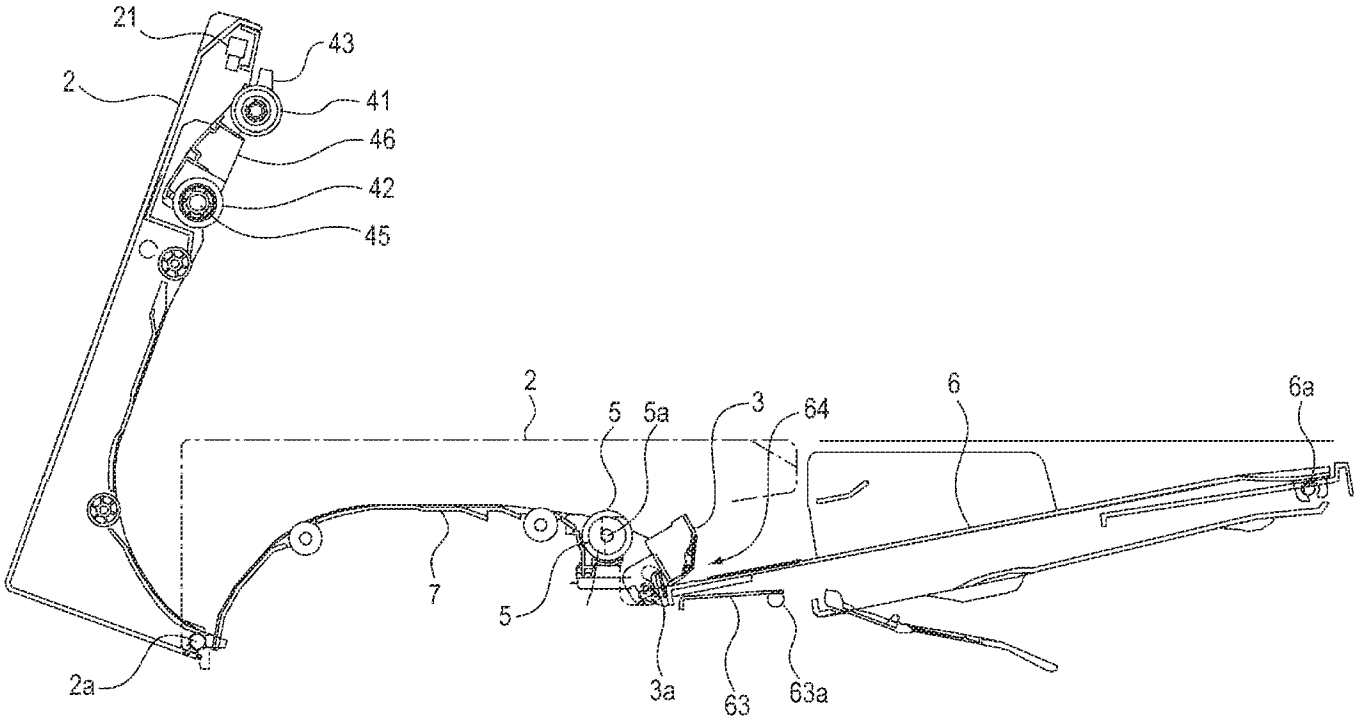
FIG. 4 is a sectional view of the ADF in replacement of a separating roller.

Also, the opened/closed cover 2 (opened/closed member) is rotatably supported with respect to a supporting shaft 2*a* of the ADF 100, and rotates and moves between an opened position to be opened with respect to an apparatus main body of the ADF 100 and a closed position to be closed with respect thereto (see FIG. 4). The opened/closed cover 2 opens the conveyance path H when being placed in the opened position, and forms the conveyance path H when being placed in the closed position. Also, an original detecting sensor 89 that is a photo-interrupter and that detects a top surface of the sheet S stacked in the original tray 6 is provided inside the opened/closed cover 2. The original detecting sensor 89 is used with a flag 43 formed in the pick arm 46. A detailed detecting operation by the original detecting sensor 89 will be described later.

The separating roller 5 is axially supported by a rotation shaft 5*a* in a rotatable manner. Also, a torque limiter (not illustrated) is attached to the rotation shaft 5*a*. The torque limiter applies, to the separating roller 5, torque in an opposite direction of a rotation direction of the separating roller 5 in feeding of the sheet S. The separating roller 5 separates the sheet S one by one by this torque. Also, the rotation shaft 5*a* of the separating roller 5 is covered with a separation cover 3 (cover member). The separation cover 3 will be described later.

When the ADF 100 reads an image on a sheet S, the sheet S stacked in the original tray 6 is first fed by the pick roller 41 and conveyed to the conveyance path H by the feed roller 42 while being separated one by one by the separating roller 5. The sheet S conveyed to the conveyance path H is conveyed on the first glass plate 201 by the pair of feed rollers 4*a* to 4*c* while being guided by an upper guide 9 and a lower guide 7.

Next, the first scanner unit 202 irradiates the sheet S with light through the first glass plate 201 and reads an image on a first surface of the sheet S. Subsequently, in a case where an instruction to read a second surface of the sheet S is given from a user, an image on the second surface of the sheet S is read by the second scanner unit 205. Subsequently, the sheet S is discharged to a discharge portion 18 by a pair of discharge rollers 17.

<Controller>

Next, a configuration of a controller of the ADF 100 will be described.

Figure 2:
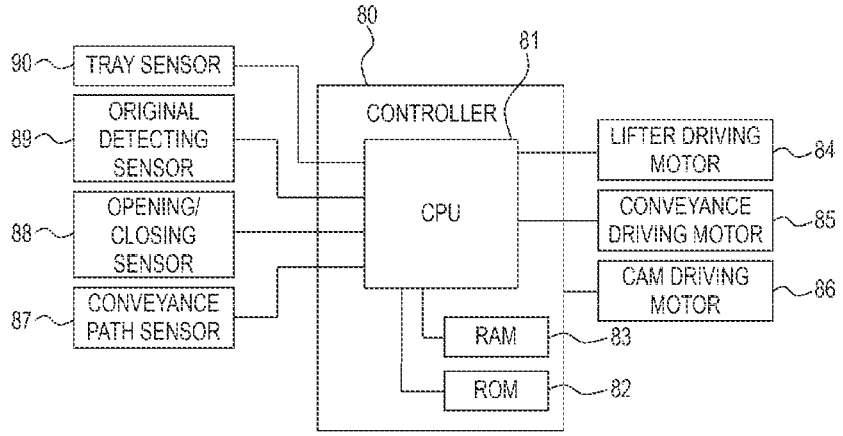
FIG. 2 is a block diagram illustrating a system configuration of an ADF.

FIG. 2 is a block diagram illustrating a system configuration of the ADF 100. As illustrated in FIG. 2, the controller of the ADF 100 includes a CPU 81, a ROM 82, and a RAM 83. A control program is stored in the ROM 82. Input data or working data is stored in the RAM 83. The CPU 81 performs various kinds of arithmetic processing by using the RAM 83 as a workspace based on the program stored in the ROM 82.

Also, a lifter driving motor 84 to be a driving source to drive the lifter driving shaft 63*a* rotationally, a pick roller 41, a feed roller 42, and a conveyance driving motor 85 to be a driving source of the pair of feed rollers 4 are connected to a controller 80. Also, a cam driving motor 86 to be a driving source of the cam (not illustrated) that controls a rotation of the pick arm 46 is connected to the controller 80.

Also, a conveyance path sensor 87, an opening/closing sensor 88, an original detecting sensor 89, and a tray sensor 90 are connected to the controller 80. The tray sensor 90 detects the sheet S stacked in the original tray 6. The opening/closing sensor 88 detects that the opened/closed cover 2 is placed in the closed position.

The conveyance path sensor 87 is provided in the conveyance path H and detects the sheet S conveyed to the conveyance path H. Conveyance information of the sheet S detected by the conveyance path sensor 87 is temporarily stored in the RAM 83. Based on the conveyance information temporarily stored in the RAM 83, the controller 80 performs a fine adjustment of driving timing of the conveyance driving motor 85, or the like and performs conveyance speed control of the sheet S with the ADF 100.

<Image Reading Sequence>

Next, an image reading sequence of the sheet S by the ADF 100 will be described with reference to a flowchart illustrated in FIG. 3.

Figure 3:
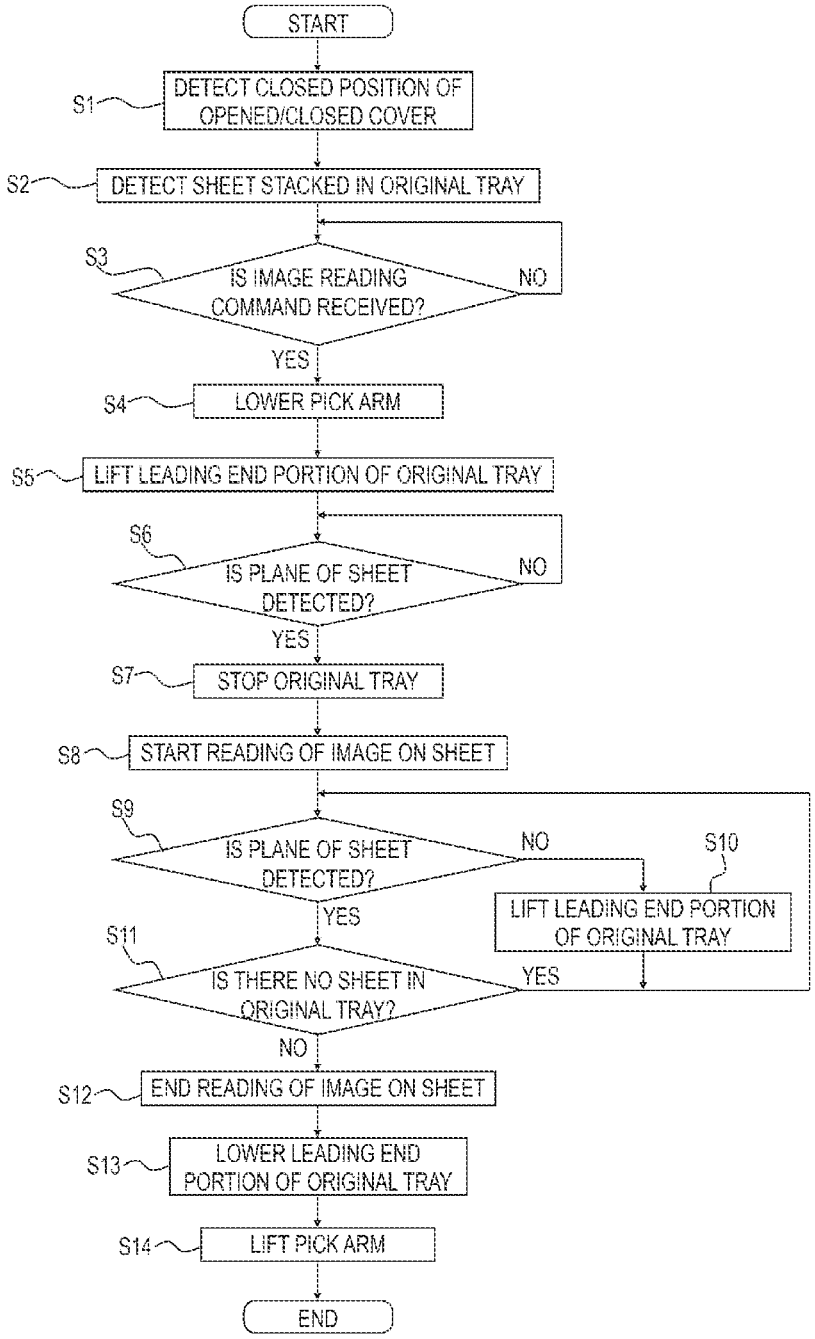
FIG. 3 is a flowchart illustrating control in image reading by the ADF.

As illustrated in FIG. 3, first, the controller 80 detects, with the opening/closing sensor 88, that the opened/closed cover 2 is in the closed position and detects, with the tray sensor 90, the sheet S stacked in the original tray 6 (S1 and S2). Next, when receiving an image reading command of the sheet S from a user, the controller 80 drives the cam driving motor 86 and the lifter driving motor 84, and lowers the pick arm 46 and lifts a leading end portion of the original tray 6 (S3 to S5).

Along with lowering of the pick arm 46, the flag 43 formed in the pick arm 46 is also lowered. When the flag 43 is lowered in such a manner, light from a light-emitting element of the original detecting sensor 89 which light is blocked with the flag 43 is detected by a light-receiving element. When the light-receiving element of the original detecting sensor 89 detects light in such a manner, the controller 80 determines that a plane of the sheet S is not detected.

Subsequently, the pick roller 41 that is lowered along with the pick arm 46, and the sheet S stacked in the lifted original tray 6 abut on each other. The original tray 6 is kept lifted even after the pick roller 41 and the sheet S stacked in the original tray 6 abut on each other. Accordingly, lowering of the pick arm 46 is stopped, and the pick arm 46 is lifted along with the original tray 6 by being pushed up by the sheet S stacked in the original tray 6.

Subsequently, the flag 43 formed in the pick arm 46 reaches a position where the light from the light-emitting element of the original detecting sensor 89 is blocked. When the light of the light-receiving element of the original detecting sensor 89 is blocked in such a manner, the controller 80 determines that a plane of the sheet S is detected ON (S6). Next, the controller 80 lifts the original tray 6 for a predetermined amount, and the pick roller 41 arranges the original tray 6 in a position suitable for feeding of the sheet S and stops the original tray 6 (S7). The original tray 6 is moved from the standby position to the feeding position in such a manner.

Next, the controller 80 starts feeding of the sheet S by driving the conveyance driving motor 85, and starts a reading operation of an image on the sheet S (S8). Feeding is performed each time the reading operation of an image is performed and a height of a top surface of the sheet S stacked in the original tray 6 is lowered. In association with this, the pick arm 46 is lowered along with the pick roller 41 and the flag 43. When the flag 43 is lowered to a position where the light from the light-emitting element of the original detecting sensor 89 cannot be blocked, the controller 80 determines that a plane of a sheet is not detected, and lifts the original tray 6 again by driving the lifter driving motor 84 (S9 and S10).

Next, the reading operation of an image on the sheet S is kept performed, and the sheet S stacked in the original tray 6 eventually disappears. The controller 80 detects that there is no longer a sheet S in the original tray 6 from a detection result by the tray sensor 90, stops the conveyance driving motor 85, and ends the reading operation of an image on the sheet S (S11 and S12).

Subsequently, the controller 80 drives the lifter driving motor 84, lowers and moves a leading end portion of the original tray 6 to the standby position (S13). Also, the controller 80 drives the cam driving motor 86 and lifts the pick arm 46 (S14). Accordingly, the image reading sequence is ended.

<About Replacement of Separating Roller>

To the separating roller 5, a force in the conveying direction of the sheet S by the feed roller 42 or the sheet S, and a force in an opposite direction of the conveying direction of the sheet S by the torque limiter (not illustrated) are applied. Thus, abrasion is more likely compared to the pair of feed rollers 4 to which only a force in the conveying direction of the sheet S is applied, and there are many cases where replacement to a new product becomes necessary in a period shorter than a product life of the ADF 100. Thus, next, a replacement operation of the separating roller 5 will be described.

Figure 5:
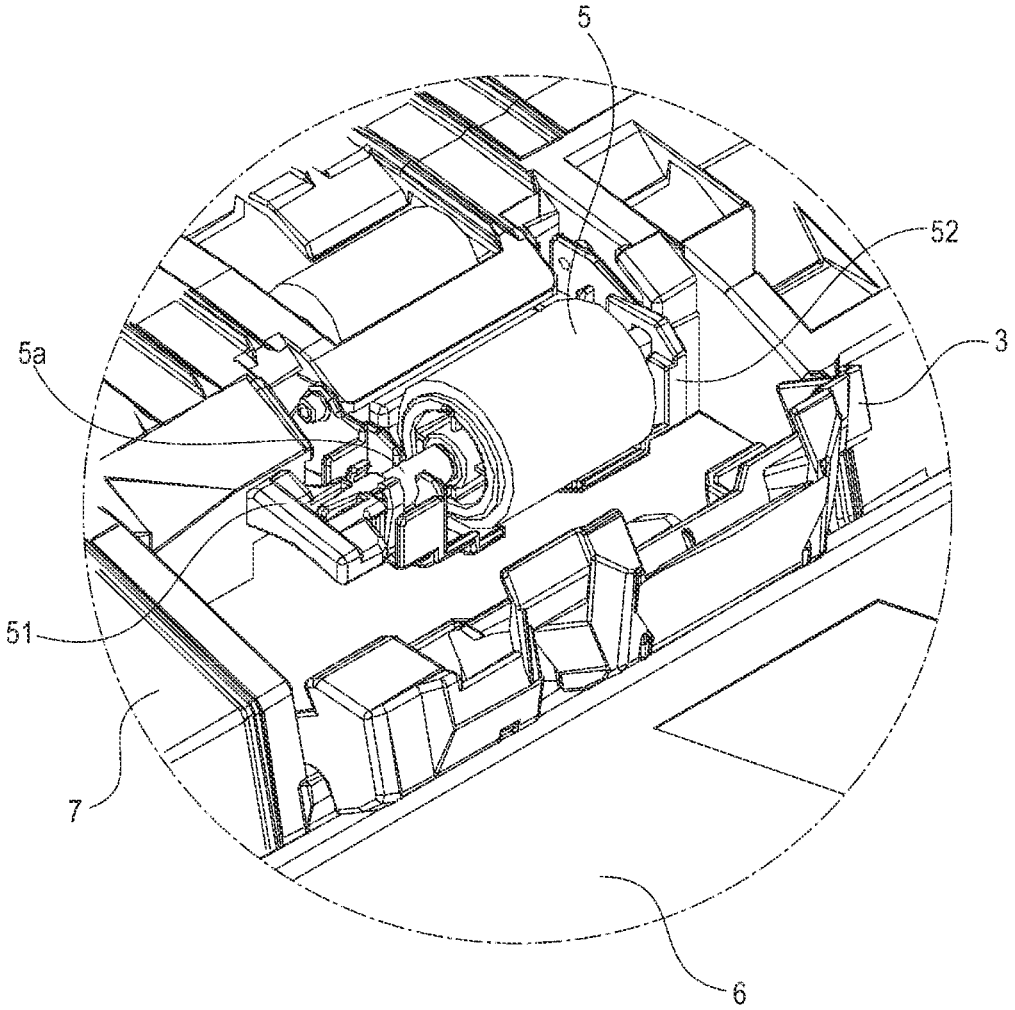
FIG. 5 is a perspective view of the ADF in replacement of the separating roller.

FIG. 4 and FIG. 5 are a sectional view and a perspective view illustrating the ADF 100 in replacement of the separating roller 5. As illustrated in FIG. 4 and FIG. 5, in replacement of the separating roller 5, an operator who performs replacement first moves the opened/closed cover 2 from the closed position to the opened position. Accordingly, the conveyance path H is opened. Thus, a space through which the separating roller 5 is extracted is secured and the separation cover 3 and the separating roller 5 are exposed.

The separation cover 3 is rotatably supported by a separation cover shaft 3*a*, and can rotate and move between a cover position in which the rotation shaft 5*a* of the separating roller 5 is covered and the sheet S is guided to the separating nip portion, and a retraction position in which the rotation shaft 5*a* of the separating roller 5 is exposed. Also, the separation cover 3 is placed in the cover position in a normal operation such as reading of an image.

The separation cover 3 rotates to an upstream side in the conveying direction of the sheet S when moving from the cover position to the retraction position. Thus, when the separation cover 3 is moved to the retraction position, it is possible to suppress entrance of the sheet S stacked in the original tray 6 (specifically, sheet S with a narrow width such as business card) into the conveyance path H. Note that a space 64 in which the separation cover 3 placed in the retraction position is arranged is provided in the leading end portion of the original tray 6. Thus, even when the sheet S is stacked in the original tray 6, it is possible to move the separation cover 3 from the cover position to the retraction position.

Next, the operator moves the separation cover 3 from the cover position to the retraction position. Accordingly, the rotation shaft 5*a* of the separating roller 5 is exposed, and a grip portion 51 provided at an end portion of the rotation shaft 5*a* of the separating roller 5 is exposed. The operator grips the exposed grip portion 51, detaches the separating roller 5 from a separating holder 52 along with the rotation shaft and attaches a new separating roller 5 to the separating holder 52. Subsequently, the operator moves the separation cover 3 from the retraction position to the cover position, and moves the opened/closed cover 2 from the opened position to the closed position. This is the end of the replacement operation of the separating roller 5.

Note that the separation cover 3 is biased, with the following configuration, in a direction from the retraction position toward the cover position when being placed in the cover position, and is biased in a direction from the cover position toward the retraction position when being placed in the retraction position.

Figure 6A:
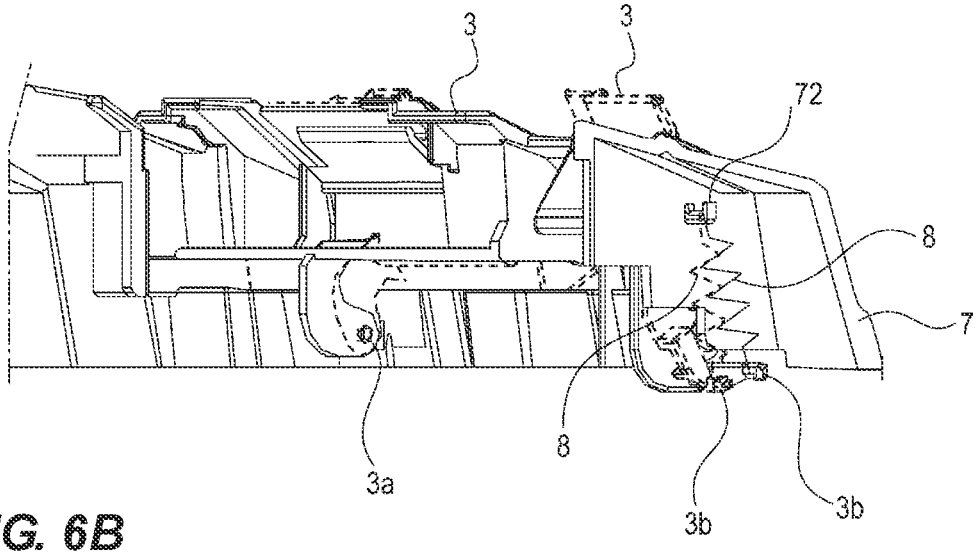
FIGS. 6A and 6B are a perspective view and a sectional view of a periphery of a separation cover.
Figure 6B:
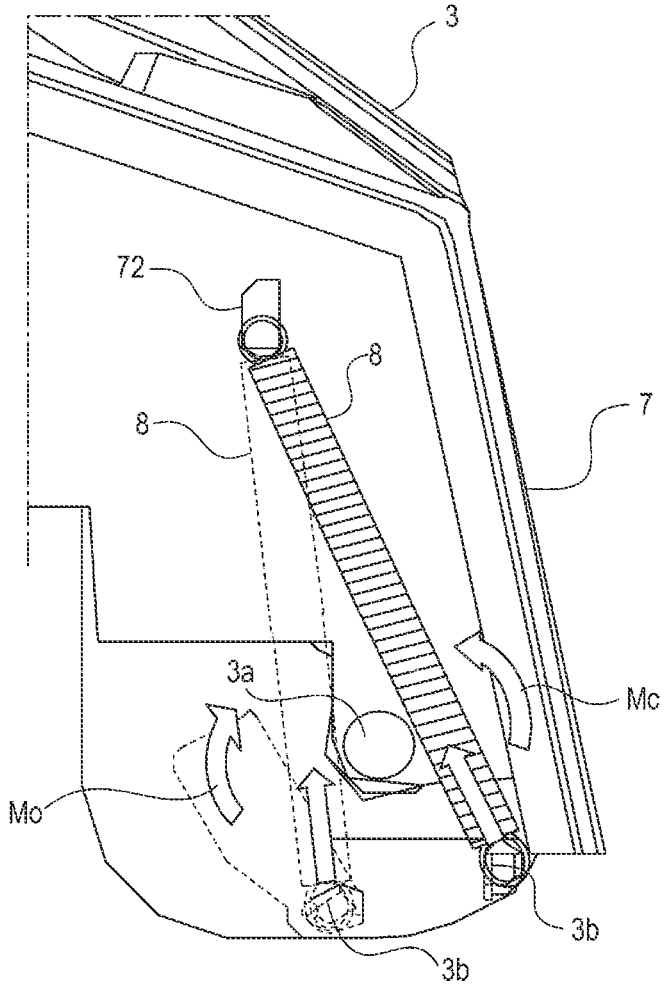

FIG. 6A is a perspective view of a periphery of the separation cover 3 and is a perspective view of when the separation cover 3 is seen from a lower side and in a downstream side in the conveying direction of the sheet S. FIG. 6B is a sectional view of the periphery of the separation cover 3. Note that in FIGS. 6A and 6B, the separating roller 5 is omitted.

As illustrated in FIGS. 6A and 6B, a spring 8 that is a tension spring is suspended between a spring hook portion 3*b* formed in the separation cover 3 and a spring hook portion 72 formed in the lower guide 7 that guides the sheet S. When the separation cover 3 is placed in the retraction position, the spring hook portion 3*b* is placed on the downstream side in the conveying direction of the sheet S compared to the separation cover shaft 3*a*. Accordingly, a biasing force by the spring 8 generates a moment in an arrow MO direction illustrated in FIG. 3B, and the separation cover 3 is biased in a direction from the cover position toward the retraction position.

On the other hand, when the separation cover 3 is placed in the cover position, the spring hook portion 3*b* is placed on an upstream side in the conveying direction of the sheet S compared to the separation cover shaft 3*a*. Accordingly, the biasing force by the spring 8 generates a moment in an arrow Mc direction illustrated in FIG. 3B, and the separation cover 3 is biased from the retraction position toward the cover position.

<Separation Cover and Original Tray>

A case where it is forgotten to move the separation cover 3 from the retraction position toward the cover position after the separation cover 3 is replaced is assumed. When a sheet S is fed in a state in which the separation cover 3 is placed in the retraction position, there is a possibility that the sheet S is stuck with the rotation shaft of the separating roller 5, or the like and a jam is generated. Thus, in the present embodiment, the separation cover 3 placed in the retraction position is moved to the cover position along with an operation of moving the original tray 6 from the standby position to the feeding position. In the following, this operation will be described.

Figure 7A:
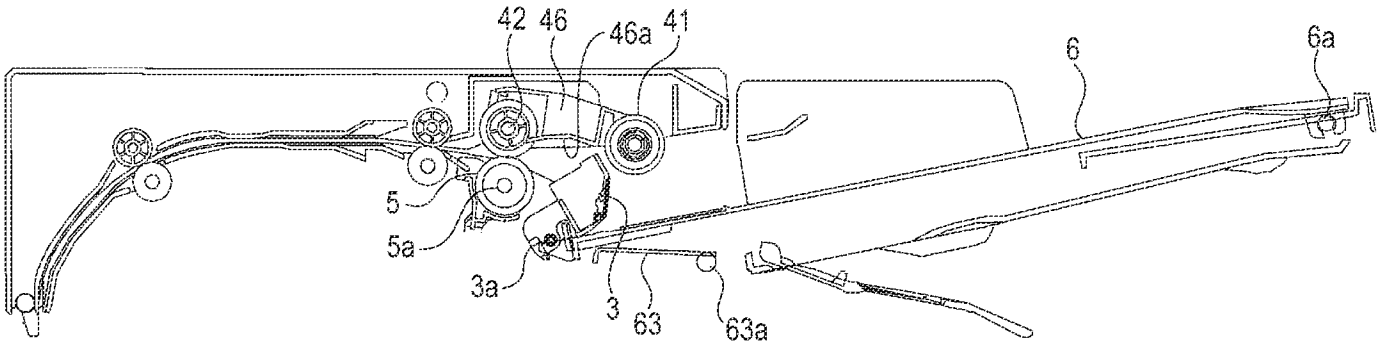
FIGS. 7A to 7C are sectional views of the ADF.
Figure 7B:
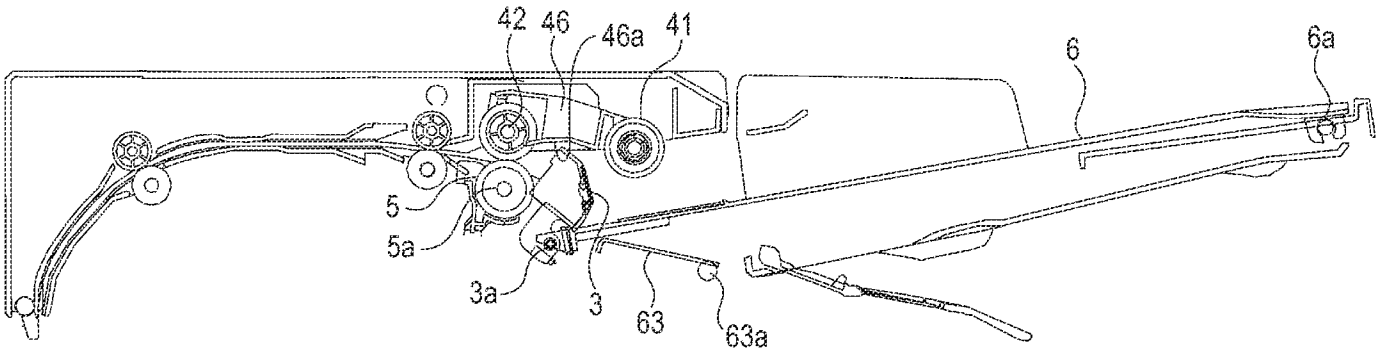
Figure 7C:
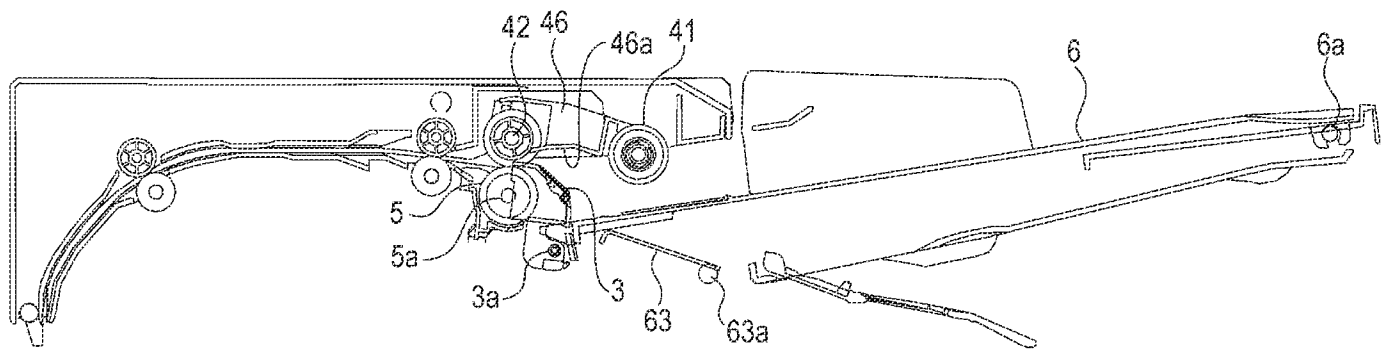

FIGS. 7A to 7C are sectional views of the ADF 100, illustrating, in order of FIG. 7A to FIG. 7C, an operation in which the separation cover 3 placed in the retraction position moves to the cover position along with an operation in which the original tray 6 moves from the standby position to the feeding position.

First, as illustrated in FIG. 7A, when the controller 80 drives the lifter driving motor 84 in a state in which the separation cover 3 is placed in the retraction position, the leading end portion of the original tray 6 is lifted and movement from the standby position to the feeding position is started. Accordingly, the leading end portion of the original tray 6 abuts on the separation cover 3.

Next, as illustrated in FIG. 7B, when the leading end portion of the original tray 6 is further lifted, the separation cover 3 is pushed upward from below by the original tray 6, and the separation cover 3 starts rotating around the separation cover shaft 3*a* from the retraction position toward the cover position.

Next, as illustrated in FIG. 7C, when the leading end portion of the original tray 6 is further lifted, the separation cover 3 further rotates and eventually moves to the cover position. With such a configuration, it is possible to move the separation cover 3 placed in the retraction position to the cover position along with movement of the original tray 6 from the standby position toward the feeding position. Thus, it is possible to suppress a jam of the sheet S due to forgetting to close the separation cover 3.

Also, as described in the above sequence, the pick arm 46 is lowered when the original tray 6 moves from the standby position to the feeding position. Here, a recessed portion 46*a* is formed in the pick arm 46. Since the separation cover 3 moves to the cover position through the recessed portion 46*a* when moving from the retraction position to the cover position along with movement of the original tray 6, the separation cover 3 and the pick arm 46 do not interfere with each other. Thus, it is possible to control interruption in movement of the separation cover 3 or pushing upward with respect to the pick arm 46 due to interference between the two.

Also, as described above, when the separation cover 3 is placed in the cover position, the separation cover 3 is biased in a direction from the retraction position toward the cover position by the biasing force by the spring 8. Thus, in a case where the original tray 6 abuts after the separation cover 3 moves to the cover position, it is possible to suppress movement of the separation cover 3 to the retraction position.

Note that in the present embodiment, the controller 80 notifies a user, by a display on an operation portion (not illustrated), that replacement of the separating roller is necessary at timing at which the number of sheets S an image on which is read by the ADF 100 reaches a predetermined number. However, the present invention is not limited to this. For example, a configuration of monitoring conveyance information in an interval, in which passing through the separating roller 5 is performed, with the conveyance path sensor 87 and giving notification at timing at which a conveyance level becomes a predetermined level or lower may be employed. Also, a configuration in which conveyance performance is determined from a value of current flowing in the conveyance driving motor 85, or the like and notification is given at timing at which a performance level becomes a predetermined level or lower may be employed.

Second Embodiment

Next, a second embodiment of an image reading apparatus including a sheet feeding apparatus according to the present invention will be described with reference to the drawings. The same drawing and the same sign are assigned to a part overlapping with the description of the above-described first embodiment, and a description thereof is omitted.

Figure 8:
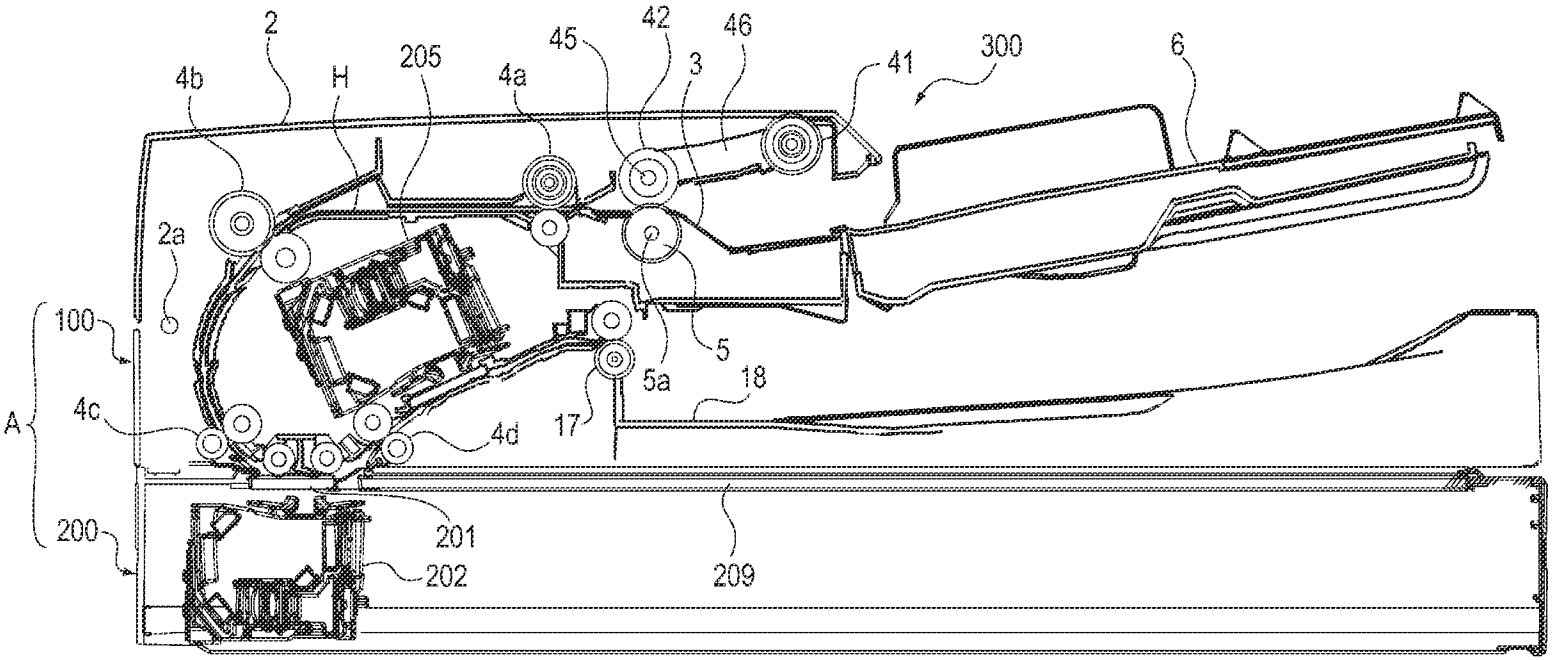
FIG. 8 is a cross-sectional schematic view of an image reading apparatus.

FIG. 8 is a cross-sectional schematic view of an image reading apparatus A according to the present embodiment. As illustrated in FIG. 8, a configuration in which an original tray 6 is fixedly supported and does not rotate is employed in the present embodiment. Thus, when a sheet S is fed, a pick arm 46 is lowered by the above-described method and a pick roller 41 abuts on the sheet S in the original tray 6. That is, the pick roller 41 moves between a standby position (first position) separated from the sheet S stacked in the original tray 6, and a feeding position (second position) in which the pick roller 41 is lowered from the standby position, abuts on the sheet S stacked in the original tray 6, and can feed the sheet S.

Note that a lifter 63 and an original detecting sensor 89 are not provided in the present embodiment. Thus, in an image reading sequence illustrated in FIG. 3, a process of using the original detecting sensor 89 (S6 and S9) and a process of moving the original tray 6 (S5, S7, S10, and S13) are not performed, and a different process is performed.

Figure 9:
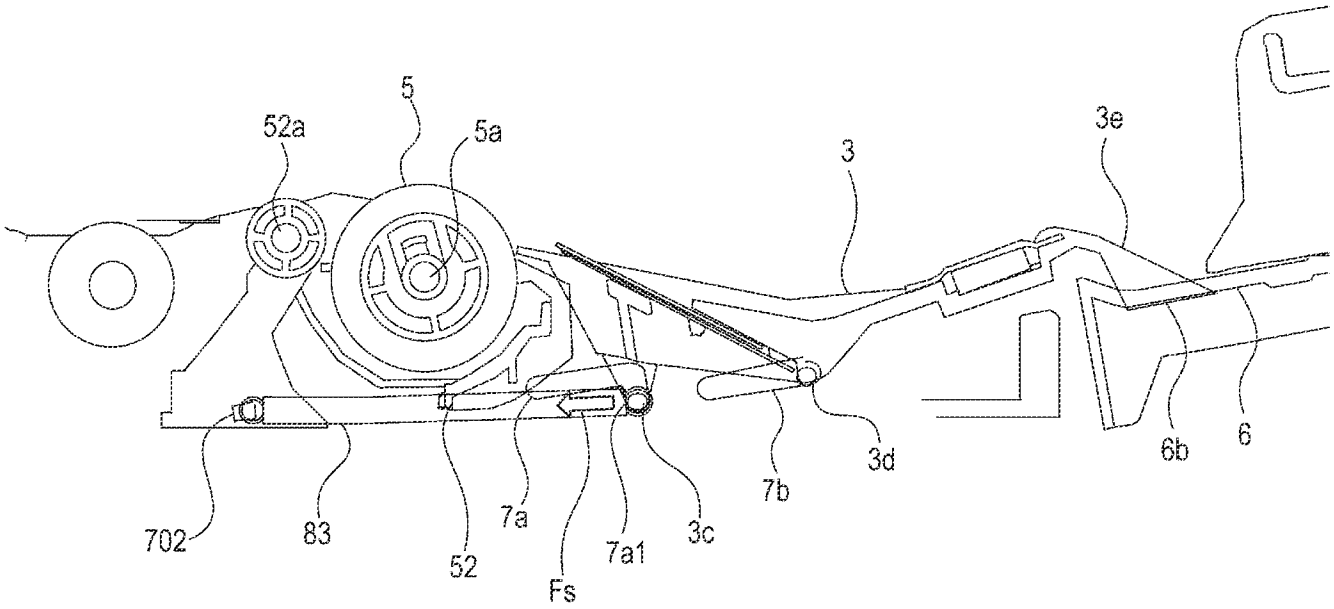
FIG. 9 is a sectional view of an ADF in replacement of a separating roller.
Figure 10:
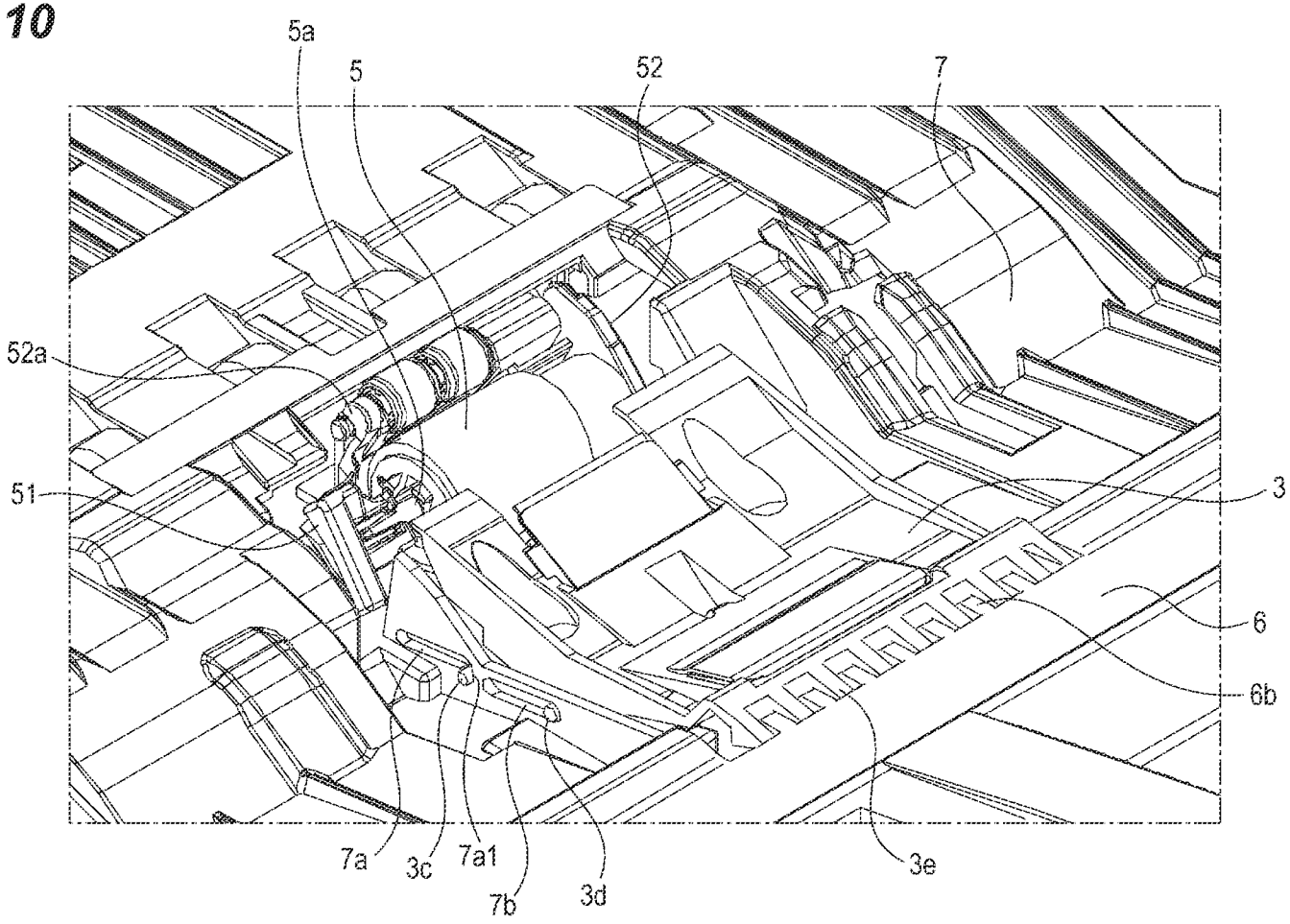
FIG. 10 is a perspective view of the ADF in replacement of the separating roller.

FIG. 9 and FIG. 10 are a sectional view and a perspective view of an ADF 100 in replacement of a separating roller 5. As illustrated in FIG. 9 and FIG. 10, in replacement of the separating roller 5, an opened/closed cover 2 is moved from a closed position to an opened position, and a separation cover 3 is moved from a cover position to a retraction position. Accordingly, a conveyance path H is opened, and the separating roller 5 and the separation cover 3 are exposed.

In the present embodiment, the separation cover 3 moves between the cover position and the retraction position by sliding and moving in a conveying direction of the sheet S. In the separation cover 3, circular bosses 3*c* and 3*d* are provided. The bosses 3*c* and 3*d* are respectively engaged with an L-shaped guide hole 7*a* (engagement hole) and a linear guide hole 7*b* (engagement hole) that are formed in a lower guide 7. Accordingly, the separation cover 3 slides and moves between a retraction position on an upstream side in the conveying direction of the sheet S and a cover position on a downstream side while being guided by the guide holes 7*a* and 7*b*.

Also, a spring 83 (biasing member) that is a tension spring is suspended between the boss 3*c* and a spring hook portion 702 of the lower guide 7. The spring 83 applies a force to the boss 3*c* on a lower side and the downstream side in the conveying direction of the sheet S (arrow Fs direction illustrated in FIG. 9). When the separation cover 3 moves from the cover position to the retraction position, the boss 3*c* moves to a restricting portion 7*a*1 that is a lower end portion of the guide hole 7*a* by a downward biasing force by the spring 83 after moving from a downstream end portion to an upstream end portion in the conveying direction of the sheet S in the guide hole 7*a*. In such a manner, since the boss 3*c* of the separation cover 3 is engaged with the restricting portion 7*a*1 of the guide hole 7*a*, movement of the boss 3*c* in the conveying direction of the sheet S is restricted, and movement of the separation cover 3 from the retraction position to the cover position is restricted.

Also, a separating holder 52 (holding member) that holds the separating roller 5 is swingably supported by a supporting portion 52*a* and is biased upward by a spring (not illustrated). Then, restriction in movement to an upper side due to a contact with the separation cover 3 is released along with movement of the separation cover 3 from the cover position to the retraction position, and the separating holder 52 swings to a side of the conveyance path H with the supporting portion 52*a* as a center. Accordingly, an operator can more easily access the separating holder 52 and more easily attach/detach the separating roller 5.

Also, an upstream end portion, in the conveying direction of the sheet S, of the separation cover 3 and a downstream end portion, in the conveying direction of the sheet S, of the original tray 6 are comb tooth-shaped comb-tooth portions 3*e* and 6*b* (recessed and protruded portion), and are arranged alternately. Accordingly, when being seen in a direction of a rotational axis of the separating roller 5, the separation cover 3 placed in the retraction position and the original tray 6 overlap with each other. With such a configuration, it is possible to reduce a distance between the separation cover 3 and the original tray 6 in the sheet conveying direction. Thus, when the separation cover 3 is placed in the cover position, it is possible to suppress damage on the sheet S due to the sheet S being stuck in a region between the separation cover 3 and the original tray 6.

Also, in the present embodiment, the separation cover 3 placed in the retraction position is moved to the cover position along with an operation in which the pick roller 41 moves from the standby position to the feeding position. In the following, this operation will be described.

Figure 11A:
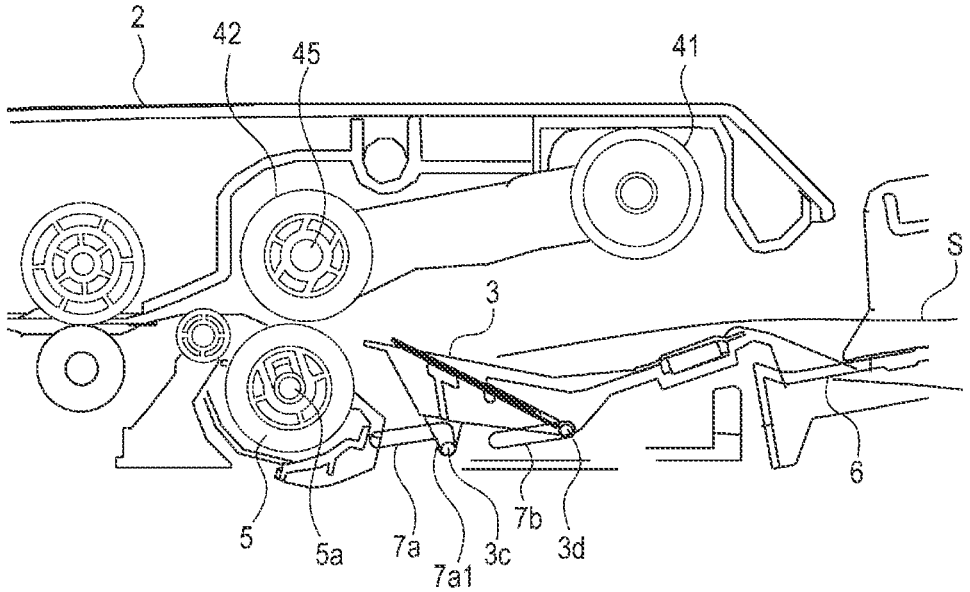
FIGS. 11A and 11B are sectional views of the ADF.
Figure 11B:
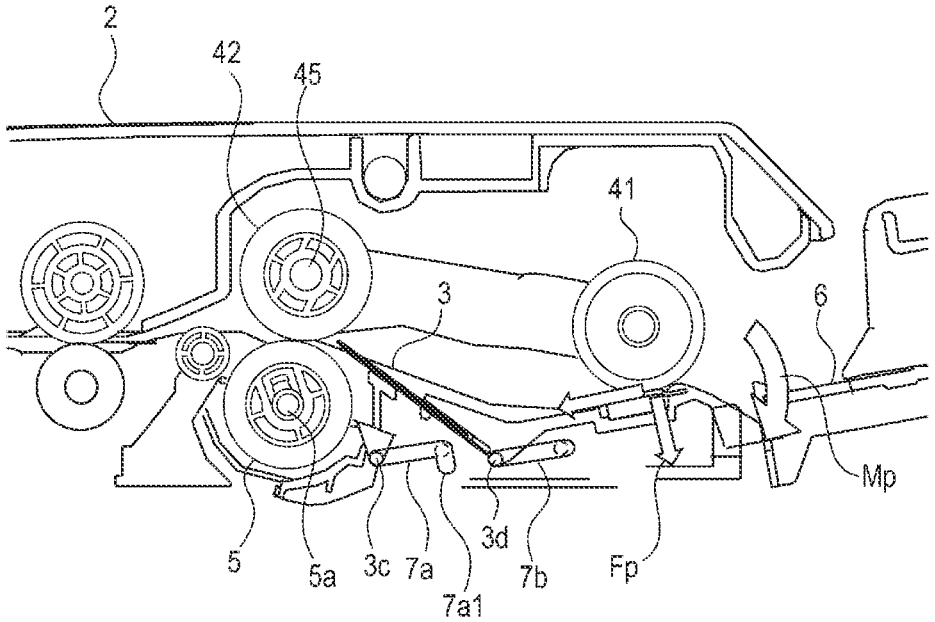

FIGS. 11A and 11B are sectional views of the ADF 100, illustrating, in order of FIG. 11A and FIG. 11B, an operation in which the separation cover 3 placed in the retraction position moves to the cover position along with an operation in which the pick roller 41 moves from the standby position to the feeding position.

As illustrated in FIGS. 11A and 11B, first, in a state in which the separation cover 3 is placed in the retraction position, an opening/closing sensor 88 detects that an opened/closed cover 2 is in a closed position, a tray sensor 90 detects a sheet S stacked in the original tray 6, and a command to read the sheet S is received from a user. Accordingly, a controller 80 drives a cam driving motor 86, and movement of the pick roller 41 from the standby position to the feeding position is started.

Next, the pick roller 41 contacts with the separation cover 3 placed in the retraction position. Here, the pick roller 41 contacts with the separation cover 3 on an upstream side in a conveying direction of the sheet S compared to the boss 3*d*. Note that depending on an arrangement of the sheet S stacked in the original tray 6, the pick roller 41 contacts with the separation cover 3 through the sheet S. Accordingly, a force in an arrow Fp direction illustrated in FIG. 11B which force is a resultant force of torque of a conveyance driving motor 85 and a force generated by own weight of the pick roller 41 (including pick arm 46) is applied to the separation cover 3.

The force applied to the separation cover 3 in such a manner generates a moment that rotates the separation cover 3 in an arrow Mp direction (clockwise direction) illustrated in FIG. 11B. With this moment, the boss 3*c* moves upward from the restricting portion 7*a*1 in the guide hole 7*a* against a downward biasing force by the spring 83, and engagement with the restricting portion 7*a*1 of a separation cover 3 (boss 3*c*) is released. Accordingly, movement of the boss 3*c* from the retraction position to the cover position is permitted.

Next, the boss 3*c* moves from a downstream side to an upstream side in a conveying direction of the sheet S along the guide hole 7*a* by the biasing force by the spring 83. Along with this, the boss 3*d* also moves from the downstream side to the upstream side in the conveying direction of the sheet S along the guide hole 7*b*. Accordingly, the separation cover 3 moves from the retraction position to the cover position. With such a configuration, it is possible to move the separation cover 3 placed in the retraction position to the cover position along with movement of the pick roller 41 from the standby position to the feeding position. Thus, it is possible to suppress a jam of the sheet S due to forgetting to close the separation cover 3.

Note that when the pick roller 41 is rotated in a state in which the pick roller 41 and the separation cover 3 are in contact with each other, a frictional force due to this rotation is applied to the separation cover 3 as a force to move the separation cover 3 from the retraction position to the cover position. With this frictional force, it is also possible to move the separation cover 3 from the retraction position to the cover position by this frictional force.

Modification Example

Next, a configuration in which a shutter 22 is provided in an AFD 100 will be described as a modification example of the present embodiment.

Figure 12:
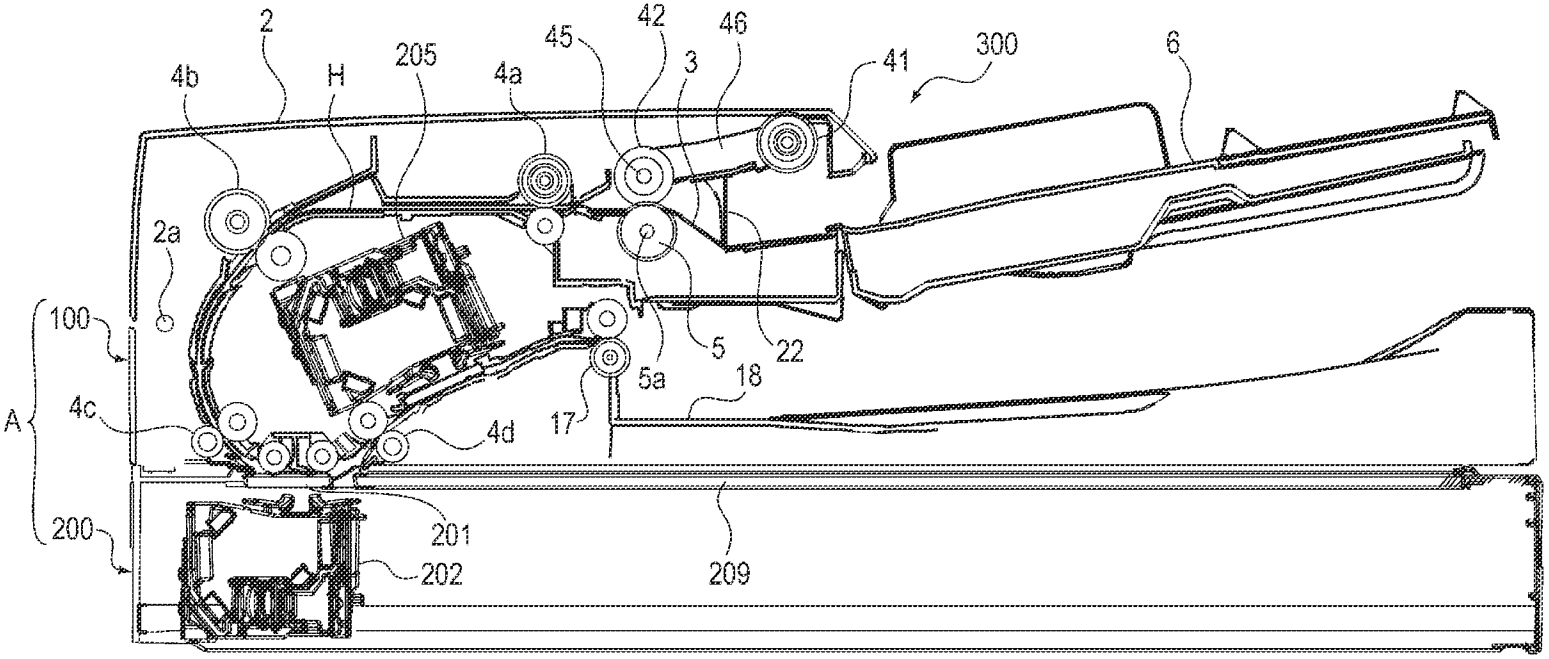
FIG. 12 is a cross-sectional schematic view of an image reading apparatus.

FIG. 12 is a cross-sectional schematic view of an image reading apparatus A according to the modification example. As illustrated in FIG. 12, the ADF 100 according to the modification example includes the shutter 22. The shutter 22 is supported by an opened/closed cover 2. Also, in the ADF 100 according to the modification example, a cam (not illustrated) to rotate a pick arm 46 is not provided and the pick arm 46 is released from a support by the opened/closed cover 2 and hangs down when the opened/closed cover 2 moves to an opened position.

When the opened/closed cover 2 is placed in a closed position, the shutter 22 is arranged in a position between a pick roller 41 and a feed roller 42 in a conveying direction of a sheet S, and is hooked by a protrusion (not illustrated) of the pick arm 46 and is brought into a position of standing in a substantially vertical direction. Accordingly, the shutter 22 restricts entrance, into a conveyance path H, of a leading end of the sheet S stacked in an original tray 6.

Here, when the pick arm 46 hangs down to a lower side along with movement of the opened/closed cover 2 to the opened position, the pick roller 41 supported by the pick arm 46 also moves to the lower side. Here, the pick roller 41 abuts on a separation cover 3 placed in a retraction position. Accordingly, the separation cover 3 moves from the retraction position to a cover position by a mechanism similar to that of the second embodiment. In such a manner, even in a configuration of the modification example, it is possible to move the separation cover 3 from the retraction position to the cover position along with a lowering operation of the pick roller 41 and to suppress a jam of the sheet S.

Third Embodiment

Next, a third embodiment of an image reading apparatus including a sheet feeding apparatus according to the present invention will be described with reference to the drawings. The same drawing and the same sign are assigned to a part overlapping with a description of the first embodiment and the second embodiment, and a description thereof is omitted.

Figure 13:
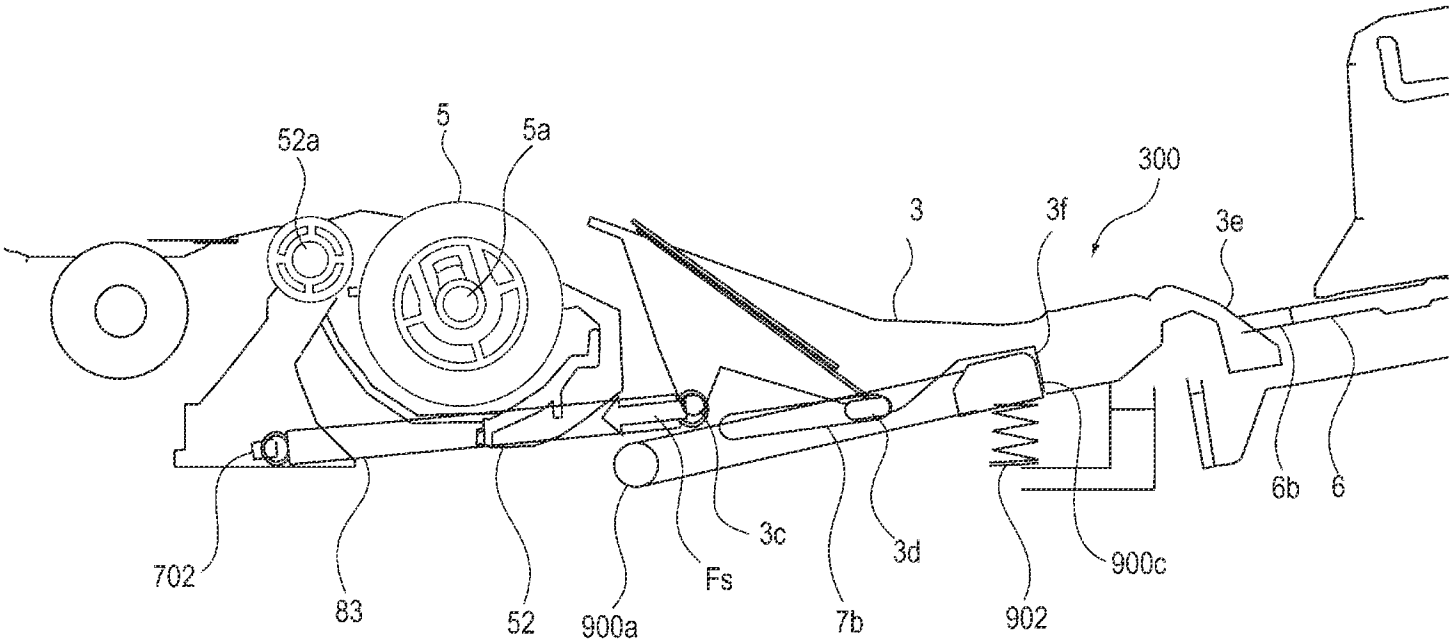
FIG. 13 is a sectional view of an ADF in replacement of a separating roller.
Figure 14:
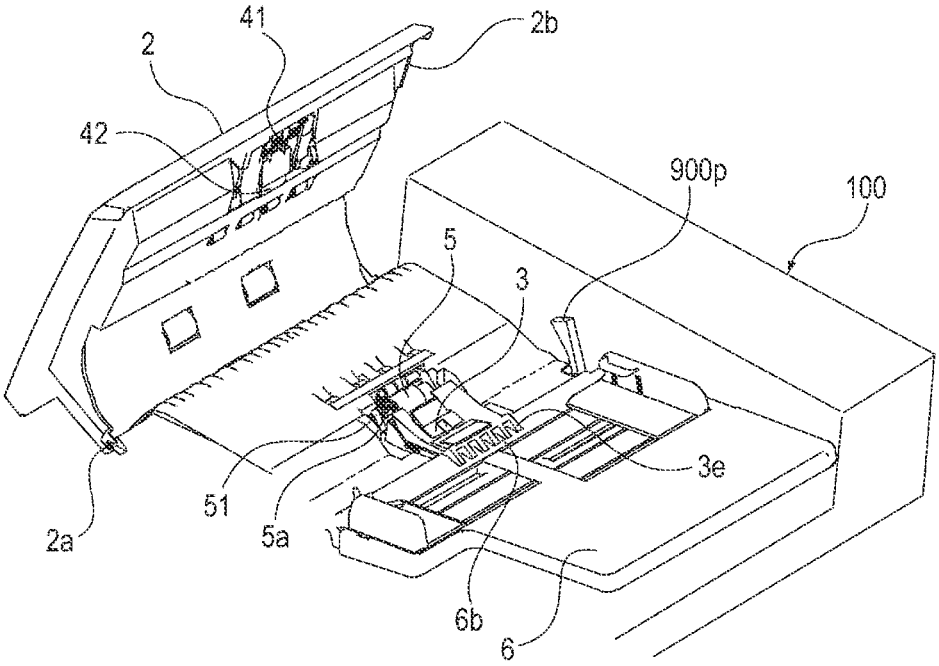
FIG. 14 is a perspective view of the ADF in replacement of the separating roller.

FIG. 13 and FIG. 14 are a sectional view and a perspective view of an ADF 100 in replacement of a separating roller 5. As illustrated in FIG. 13 and FIG. 14, the ADF 100 according to the present embodiment has a configuration in which a locking member 900 is provided instead of an L-shaped guide hole 7*a* in the configuration of the second embodiment. Since no guide hole 7*a* is provided, a boss 3*c* functions as a part where a spring 83 is hooked. The other configuration is substantially the same as the configuration of the second embodiment.

The locking member 900 (restricting portion) is supported swingably in a vertical direction by a supporting portion 900*a*, and is biased to an upper side by a spring 902 that is a compression coil spring. Also, the locking member 900 includes an engagement portion 900*c* engaged with a separation cover 3, and a contact arm 900*p* that is protruded to a side of a conveyance path H and that is in contact with a contact portion 2*b* of an opened/closed cover 2.

When the separation cover 3 is placed in a retraction position, the engagement portion 900*c* of the locking member 900 is engaged in a hooked manner with a hook portion 3*f* of the separation cover 3. In other words, the separation cover 3 is engaged with the engagement portion 900*c* of the locking member 900. Accordingly, the locking member 900 restricts movement of the separation cover 3 in a conveying direction of a sheet S, and restricts movement of the separation cover 3 from the retraction position to a cover position.

Also, in the present embodiment, along with an operation in which the opened/closed cover 2 moves from an opened position (first position) to a closed position (second position), the separation cover 3 placed in the retraction position is moved to the cover position. In the following, this operation will be described.

Figure 15A:
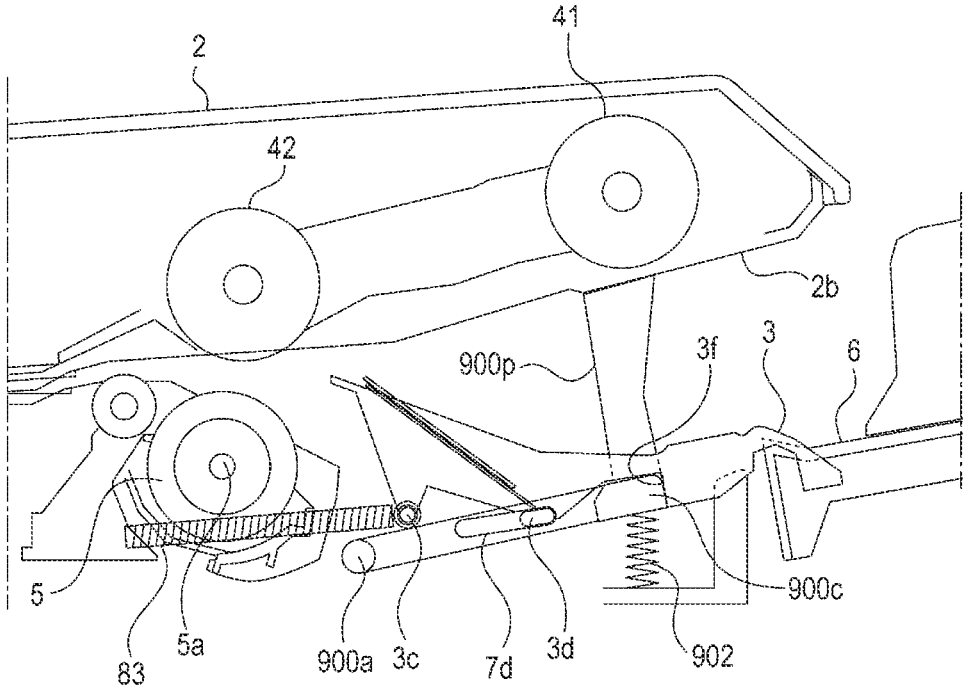
FIGS. 15A and 15B are sectional views of the ADF.
Figure 15B:
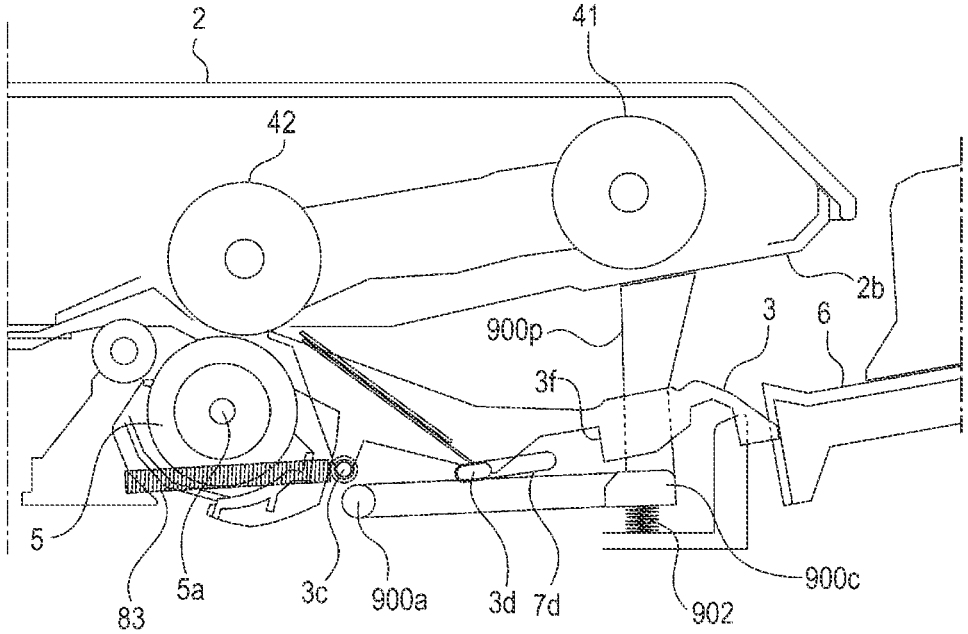

FIGS. 15A and 15B are sectional views of the ADF 100, illustrating, in order of FIG. 15A and FIG. 15B, an operation in which the separation cover 3 placed in the retraction position moves to the cover position along with an operation in which the opened/closed cover 2 moves from the opened position to the closed position.

As illustrated in FIGS. 15A and 15B, when movement of the opened/closed cover 2 from the opened position to the closed position is started, the contact portion 2*b* of the opened/closed cover 2 and the contact arm 900*p* contact with each other. When the opened/closed cover 2 is further moved from there toward the closed position, the contact arm 900*p* is pushed into a lower side by the contact portion 2*b* of the opened/closed cover 2. Accordingly, the locking member 900 swings to the lower side with the supporting portion 900*a* as a center, and the engagement portion 900*c* also moves to the lower side. With this movement of the engagement portion 900*c*, engagement between the hook portion 306 of the separation cover 3 and the engagement portion 900*c* is released, and restriction in movement of the separation cover 3 from the retraction position to the cover position is released.

When the restriction in movement of the separation cover 3 from the retraction position to the cover position is released, the separation cover 3 moves from the retraction position to the cover position by a biasing force by the spring 83. With such a configuration, along with movement of the opened/closed cover 2 from the opened position to the closed position, it is possible to move the separation cover 3 placed in the retraction position to the cover position. Thus, it is possible to suppress a jam of the sheet S due to forgetting to close the separation cover 3.

Note that a biasing force by the spring 902 that apply a force to the locking member 900 is applied to the opened/closed cover 2 through the contact arm 900*p*. Thus, it is desirable that the biasing force by the spring 902 is set to be weaker than a force to hold the opened/closed cover 2 in the closed position. Accordingly, it is possible to prevent unintentional movement of the opened/closed cover 2 from the closed position to the opened position.

Note that in the first to third embodiments, a sheet feeding apparatus 300 that feeds a sheet S toward a first scanner unit 202, which is an image reading portion to read an image, in an ADF 100 of an image reading apparatus A has been described. However, the present invention is not limited to this. That is, in the image forming apparatus, even when a configuration of the present embodiment is applied to a sheet feeding apparatus that feeds a sheet toward an image forming portion to form an image, an effect similar to what is described above can be acquired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-007228, filed Jan. 18, 2019, which is hereby incorporated by reference herein in its entirety.

What is claimed is:

1. A sheet feeding apparatus comprising:

a stacking portion on which a sheet is stacked and which is movable from a first position to a second position above the first position;

a conveying member configured to convey the sheet stacked on the stacking portion;

a separating member configured to form a nip portion with the conveying member and to separate the sheet conveyed by the conveying member in the nip portion;

a guide member that is movable between a third position to guide the sheet to the nip portion and a fourth position retracted from the third position; and a driving motor configured to move the stacking portion from the first position to the second position, wherein the stacking portion abuts on the guide member and moves the guide member from the fourth position to the third position, when the driving motor moves the stacking portion from the first position to the second position.

2. The sheet feeding apparatus according to claim 1, wherein the guide member is rotatably supported, and wherein the guide member rotates from the fourth position to the third position by an abutment of the stacking portion on the guide member when the driving motor moves the stacking portion from the first position to the second position.

3. The sheet feeding apparatus according to claim 1, further comprising a spring configured to urge the guide member in a direction from the third position toward the fourth position in a state where the guide member is placed in the fourth position.

4. The sheet feeding apparatus according to claim 3, wherein the spring is configured to urge the guide member in a direction from the fourth position toward the third position in a state where the guide member is placed in the third position.

5. The sheet feeding apparatus according to claim 1, wherein the separating member includes (1) a separating roller, (2) a rotation shaft of the separating roller, and (3) a grip portion configured to be gripped by an operator.

6. The sheet feeding apparatus according to claim 1, further comprising an arm configured to hold a sheet feeder rotatably, wherein the arm has a recessed portion through which the guide member moves from the fourth position to the third position.

7. The sheet feeding apparatus according to claim 1, wherein the stacking portion includes a leading end portion which contacts with the guide member and which moves the guide member from the fourth position to the third position.

8. The sheet feeding apparatus according to claim 1, further comprising a holder configured to hold the separating member, wherein the separating member is configured to be detachable from the holder in a state where the guide member is placed in the fourth position.

9. The sheet feeding apparatus according to claim 1, wherein the fourth position of the guide member is a position where the guide member is located on a rotational path of the stacking portion from the first position to the second position.

10. A sheet feeding apparatus comprising:

a stacking portion on which a sheet is stacked and which is movable from a first position to a second position above the first position;

a feeding member configured to feed the sheet stacked on the stacking portion;

a conveying member configured to convey the sheet fed by the feeding member;

a separating member configured to form a nip portion with the conveying member and to separate the sheet fed by the feeding member in the nip portion;

a guide member that is movable between a third position to guide the sheet to the nip portion and a fourth position retracted from the third position; and an arm configured to hold the feeding member rotatably, and having a recessed portion through which the guide member moves from the fourth position to the third position, wherein the stacking portion abuts on the guide member and moves the guide member from the fourth position to the third position, when the stacking portion moves from the first position to the second position.

11. The sheet feeding apparatus according to claim 10, wherein the guide member is rotatably supported, and wherein the guide member rotates from the fourth position to the third position by an abutment of the stacking portion on the guide member when the stacking portion moves from the first position to the second position.

12. The sheet feeding apparatus according to claim 10, further comprising a spring configured to urge the guide member in a direction from the third position toward the fourth position in a state where the guide member is placed in the fourth position.

13. The sheet feeding apparatus according to claim 12, wherein the spring is configured to urge the guide member in a direction from the fourth position toward the third position in a state where the guide member is placed in the third position.

14. The sheet feeding apparatus according to claim 10, wherein the separating member includes (1) a separating roller, (2) a rotation shaft of the separating roller, and (3) a grip portion configured to be gripped by an operator.

15. The sheet feeding apparatus according to claim 10, wherein the stacking portion includes a leading end portion which contacts with the guide member and which moves the guide member from the fourth position to the third position.

16. The sheet feeding apparatus according to claim 10, further comprising a holder configured to hold the separating member, wherein the separating member is configured to be detachable from the holder in a state where the guide member is placed in the fourth position.

17. The sheet feeding apparatus according to claim 10, further comprising a driving motor configured to move the stacking portion from the first position to the second position.

18. The sheet feeding apparatus according to claim 10, wherein the fourth position of the guide member is a position where the guide member is located on a rotational path of the stacking portion from the first position to the second position.

* * * * *